US006953293B2

(12) United States Patent
Wiersma

(10) Patent No.: US 6,953,293 B2
(45) Date of Patent: Oct. 11, 2005

(54) SYSTEM FOR GENERATING PRINTED MAIL PIECES AND COMPUTER PROGRAM CODE THEREFOR

(75) Inventor: Jelle Wiersma, Drachtster Compagnie (NL)

(73) Assignee: Neopost Industrie B.V., Drachten (NL)

( * ) Notice: Subject to any disclaimer, the term of this patent is extended or adjusted under 35 U.S.C. 154(b) by 0 days.

(21) Appl. No.: 10/028,333

(22) Filed: Dec. 28, 2001

(65) Prior Publication Data

US 2002/0122682 A1 Sep. 5, 2002

(30) Foreign Application Priority Data

Dec. 29, 2000 (NL) ..... 1017005

(51) Int. Cl.[7] ..... B41J 11/44; B41J 3/42; B41L 45/00

(52) U.S. Cl. ..... 400/76; 400/72; 101/47; 101/71

(58) Field of Search ..... 400/72, 76, 62; 101/47, 71; 382/101, 102; 700/221

(56) References Cited

U.S. PATENT DOCUMENTS 4,006,463 A * 2/1977 Hanks ..... 340/172.5
4,308,579 A * 12/1981 Dlugos ..... 364/200
4,527,468 A * 7/1985 Piotroski ..... 101/2
4,544,146 A * 10/1985 Zemke, deceased et al. .. 270/58
4,800,505 A * 1/1989 Axelrod et al. ..... 700/221
4,835,544 A * 5/1989 Winterburn ..... 346/1.1
5,058,030 A * 10/1991 Schumacher ..... 364/478
5,329,102 A * 7/1994 Sansone ..... 235/375
5,402,527 A * 3/1995 Bigby et al. ..... 395/101
5,555,703 A * 9/1996 Gombault et al. ..... 53/411
5,715,379 A * 2/1998 Pavlovic et al. ..... 395/112
5,719,776 A * 2/1998 Haug ..... 364/464.21
5,798,930 A * 8/1998 Van Oosten ..... 700/213
5,806,057 A * 9/1998 Gormley et al. ..... 707/1
5,873,073 A * 2/1999 Bresnan et al. ..... 347/4

FOREIGN PATENT DOCUMENTS

EP 0 447 179 A2 * 12/1991 ..... B07C/1/00
EP 0 574 224 A2 6/1993
EP 0 619 555 A2 10/1994
EP 0 628 357 B1 12/1994
EP 0 404 264 B1 3/1995
EP 0 745 435 A2 12/1996
EP 0 981 111 A2 2/2000
EP 1 006 432 A2 6/2000

* cited by examiner

*Primary Examiner*—Daniel J. Colilla
*Assistant Examiner*—Wasseem H. Hamdan
(74) *Attorney, Agent, or Firm*—Buchanan Ingersoll PC

(57) ABSTRACT

A system for generating printed mail pieces, starting from a print file, having: a printer for printing; a processing device for processing printed items into mail pieces; a control unit for controlling the printer and the processing device, and memory. The memory contains processing code for controlling the control unit for processing the rough pint file into a processed print file, and representation code for causing the processing instructions of the processing code to be represented in humanly perceptible form. The representation code is editable for changing at least the representations of the processing instructions and convertible into the processing code. Alternatively, the memory can contain a set of processing subroutines with which processing subroutines representation codes can be composed which differ from each other at least as regards processing instructions included therein, and which are each convertible into corresponding processing code. Also described is computer software for such a system.

23 Claims, 2 Drawing Sheets

SYSTEM FOR GENERATING PRINTED MAIL PIECES AND COMPUTER PROGRAM CODE THEREFOR

FIELD AND BACKGROUND OF THE INVENTION

The invention relates to a system for generating printed mail pieces, starting from a print file, and to a computer program code for controlling a control unit of such a system.

It has long been known, for instance from European patent specifications 0 404 264 and 0 628 357, starting from digital data that define a document, to control not only a printer, but also a processing device for processing printed material into mail pieces.

From practice it is known for a print file—which can, for instance, have been obtained from an office application such as a word processing program or a program for financial management and which, with or without using a mail merge function, can contain several documents—to be supplemented, before being sent, with processing data for the processing device, to form a processed print file. To that end, the control unit is controlled by processing code which is settable by setting dialogue code which in a window shows a menu with options for setting the processing code. The setting dialogue presents, for instance, the option of packaging documents in an envelope or not. The processing code is set in accordance with the selection entered, and operatively processes the rough print file, which, in principle, is intended for controlling a printer, through supplementation at the correct places, to form a processed file which contains instructions for the printer and for the processing unit There is a tendency that more and more possibilities of finishing printed documents are being created. The variety of wishes on the part of users of such systems then increases accordingly. The origin of address data which are to be printed on an envelope can, for instance, differ from one user to another, depending on applications and sources of data used by those users. Further, there are differences in the requirements which processing code should preferably meet for different users, for instance in the field of franking, selectively adding inserts and selectively choosing from different envelopes. Using external services as address verification, whereby access to the address data can be obtained in greatly different manners, and franking using on-line services are further examples of the many processing possibilities that occur As a consequence of all this, it is problematic to provide a processing code which is settable in accordance with the large variety of requirements that occurs. Apart from the efforts this requires, one problem is that the processing code, according as it offers more possibilities, becomes more sizeable and slower and the risk of malfunctions increases. Moreover, the operation of the settings of the processing code becomes complicated and laborious.

SUMMARY OF THE INVENTION

It is an object of the invention to provide a solution which makes it possible that the processing code for processing the rough print file for controlling a printer into the processed print file with data for controlling a printer and a processing device for processing printed material into mail pieces to be sent, be adapted in a simple manner to greatly different and unforeseen requirements without necessitating a sizeable processing code and a complex and laborious user interface.

This object is achieved according to the invention by providing a system for generating mail pieces, starting from a print file, having: a printer for printing postal items; a processing device for processing printed postal items into mail pieces; a control unit for controlling the printer and the processing device, comprising an input interface for inputting a rough print file for controlling a printer, which rough print file at least partly defines at least one document to be printed, a processor for processing the rough print file in accordance with processing instructions into a processed print file, an output interface connected with the printer and with the processing device for transmitting control signals to at least the printer or the processing device for controlling the printer and the processing device in accordance with, or formed by, the processed print file, and memory containing: processing code for controlling the control unit for processing the rough print file into a processed print file, which processing code comprises processing instructions; and representation code for causing the processing instructions to be represented in humanly perceptible form, the representation code being editable for changing at least the representations of the processing instructions, and the representation code being convertible into the processing code.

In the memory of the system, instead of, or supplemental to, the representation code, also a number of processing subroutines can be present, with which the humanly perceptible and editable representation code can be generated.

The invention can further be embodied in computer program code for operating a control unit for controlling a printer and a processing device for processing printed postal items into mail pieces, comprising: processing code for controlling the control unit for processing a rough print file for controlling a printer into a processed print file for controlling the printer and the processing device for processing printed postal items into mail pieces, which processing code comprises processing instructions; and representation code for causing the processing instructions to be represented in humanly perceptible form, the representation code being editable for changing at least the representations of the processing instructions, and the representation code being convertible into the processing code. The computer program code, too, can, instead of or supplemental to the representation code, include a number of processing subroutines with which the humanly perceptible and editable representation code can be generated.

As representation code is provided for the processing instructions of the processing code to be represented, by equipment suitable therefor, in a humanly perceptible form and flexibly editable as desired, the possibility is obtained not only of setting parameter values but also, for instance, of defining the processing code as regards variables and in particular parameters as well as processing operations in accordance with a large variety of requirements. The flexibility thereby obtained makes it redundant to priorly include a large number of variables and processing operations that can be included in the processing code and further makes redundant a complex user interface, which must be prepared for a large variety of priorly included possibilities.

For that matter, it may be advantageous to include, by standard procedure, a basic set of frequently used parameters in the processing code, and to make these settable in the usual manner, so that for current settings, specifying parameter values can be executed by the user in a simple manner accessible to a broad group of users.

Particularly advantageous embodiments of the invention are laid down in the depending claims.

In the following, the invention is described on the basis of a most preferred exemplary embodiment, and a few variants, with reference to the drawing.

DETAILED DESCRIPTION

Figure 1:
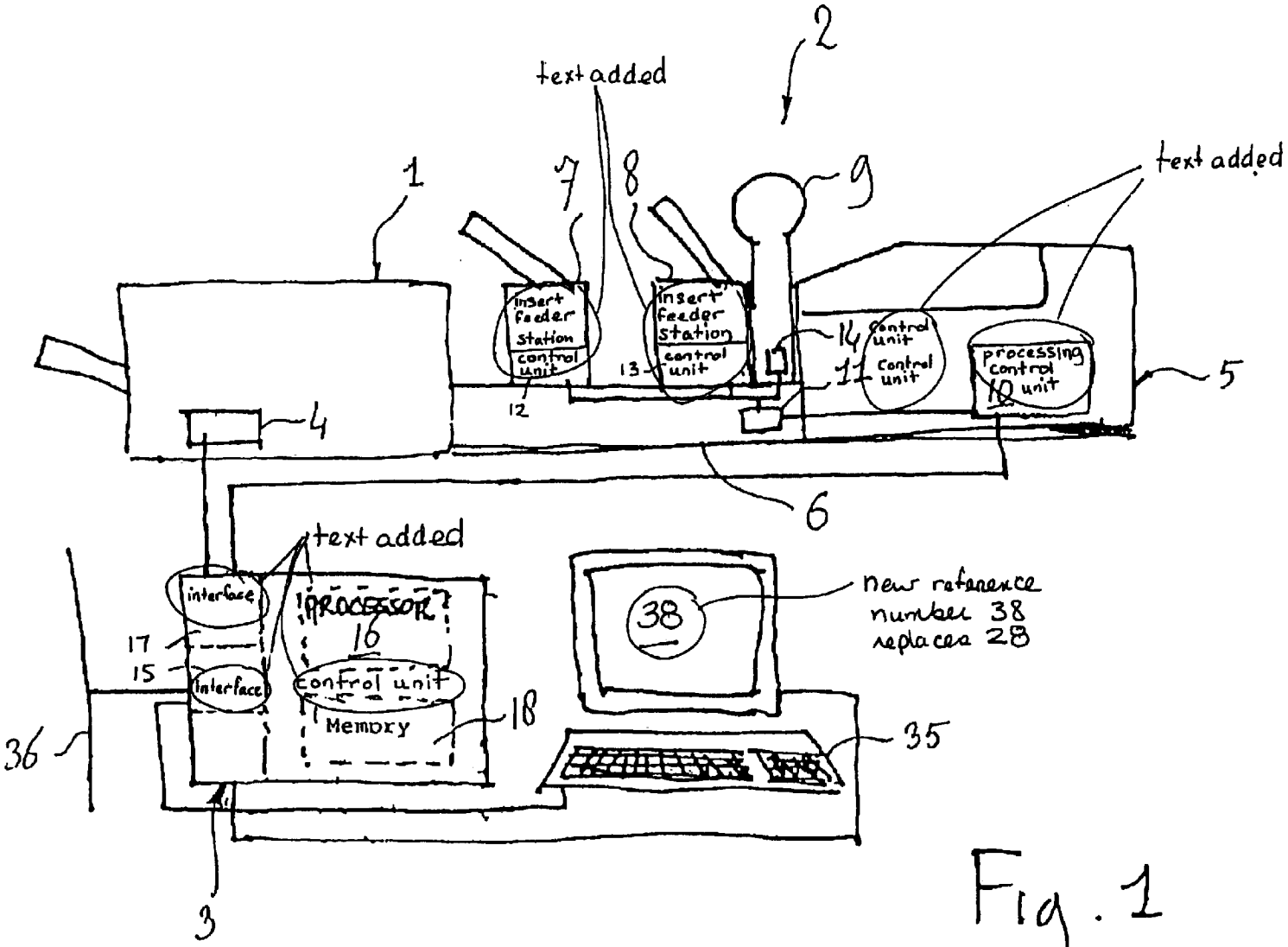
FIG. 1 is a schematic representation of a system according to the invention.

The system represented in FIG. 1 and the structure of the software described hereinafter presently constitute the most preferred exemplary embodiments of the invention. The system according to FIG. 1 is made up of a printer 1 for printing postal items, a processing device 2 for processing printed postal items into mail pieces; and a control unit 3 for controlling the printer 1 and the processing device 2.

The printer is provided with a printer control 4 for controlling the print engine and the supply, feed-through and delivery functions of the printer in accordance with control instructions received from the control unit 3. The processing device 2 according to this example is made up of an inserter station 5 for enveloping documents in envelopes, and an assembly, located upstream of the inserter station 5, consisting of a transport unit 6 which carries two insert feeder stations 7, 8 and a folding station 9. The inserter station 5 is provided with a processing control unit 10 for controlling the processing of documents by the inserter station 5 and by the stations 7–9 on the transport unit 6 in accordance with control instructions received from the control unit 3. The processing control unit 10 is connected with a control unit 11 of the transport unit 6 which communicates with control units 12, 13, 14 of the stations 7–9. The control units 10–14 of the processing device 2 are arranged for distributing, in accordance with the processing instructions coming from the control unit 3, processing instructions and sequence information to the control units 10 and 12–14 of the stations, so that the correct processing operations are executed on the correct documents.

The control unit 3 is provided with an interface 15 coupled to a network 36 for inputting a rough print file for controlling a printer. This print file, in the form in which it is supplied, does not need to be suitable to control the printer 1 directly, but does contain data which at least partly define one or more documents to be printed. The control unit 3 is further provided with a processor 16 for processing the rough print file in accordance with processing instructions into a processed print file, and an interface 17 connected with the printer 1 and with the processing device 2 for transmitting control signals to the printer 1 and the processing device in accordance with the processed print file.

The control signals can also be formed by the processed print file which, instead of being sent directly to the printer and to the processing unit, is sent to the printer or the processing unit, whereafter at least the instructions for the other one of the printer and the processing device are forwarded thereto. This last can be done, for instance, in the form of electronic or optical signals, but in particular instructions for the processing unit can also be passed on in the form of printed signs on the documents themselves or on separate items which contain only control information and are not included in mail pieces to be composed. It is also possible for the control signals to be sent in the form of, or in a form corresponding to, the processed print file, to an intermediate station which divides same into separate control signals for the printer and for the processing unit.

It is noted that the precise configuration of the processing unit will naturally vary depending on the application. The number of insert feeder stations, for instance, can be greater if it is desired to include a larger variety of inserts in a series of mail pieces. Further, there may be provided, for instance, a reading station, an accumulation station, an envelope printer, a franking machine. etc.

Figure 2:
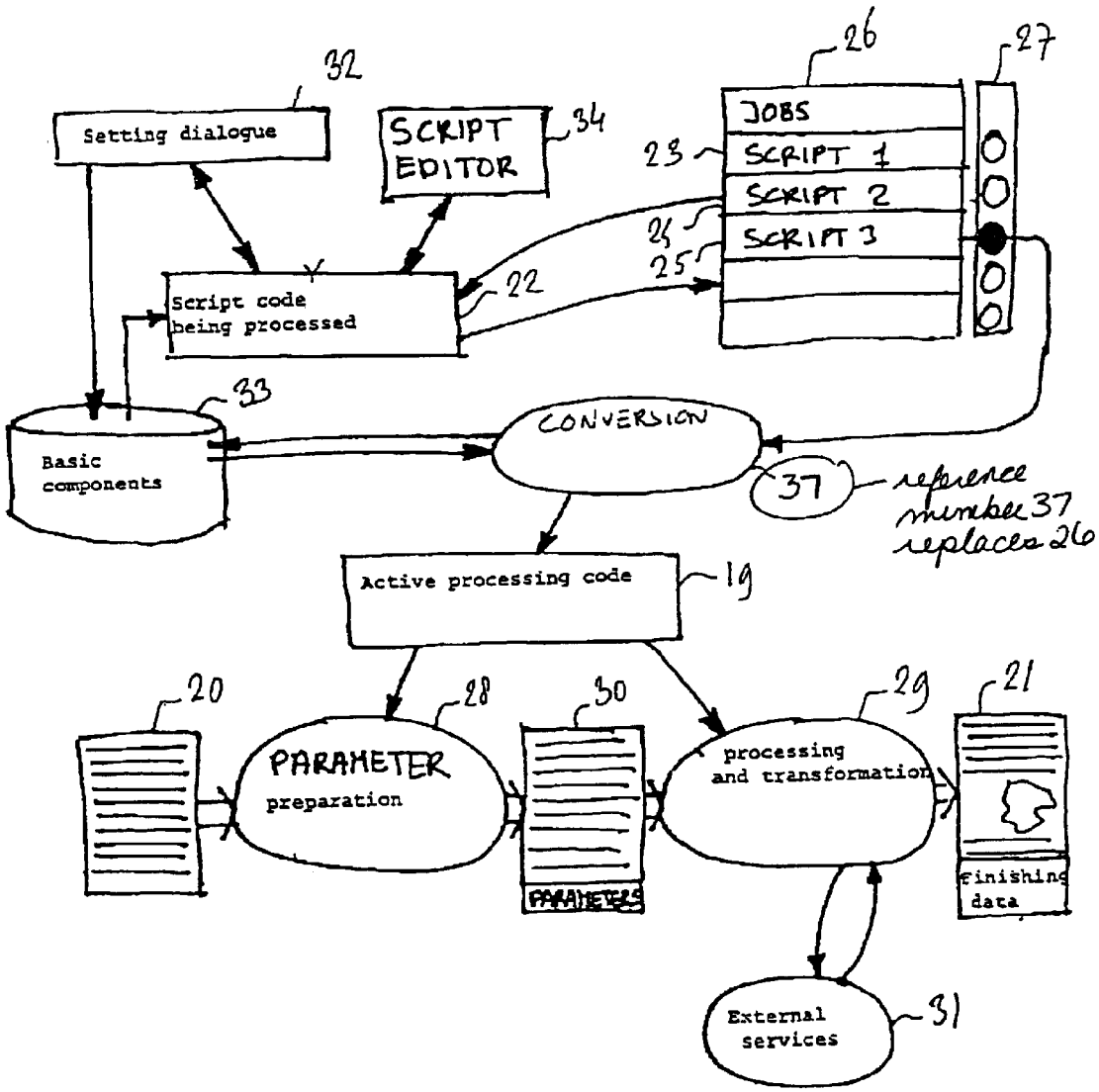
FIG. 2 is a schematic representation of computer software according to the invention.

The control unit 3 further includes a memory in the form of a hard disk on which software has been installed and working memory of the processor 16. Contained in the memory is processing code 19 (see FIG. 2 ) for controlling the control unit 3 for processing the rough print file 20 into a processed print file 21. Further contained in the memory 18 is representation code 22–25 for causing the processing instructions to be represented in humanly perceptible form. This representation code is editable for changing the representations of the processing instructions and is convertible into processing code 19 by means of a conversion operation 37.

The representation code can, for instance, be stored after the processing code has been taken from it through compilation. It is also possible to provide that the processing code arises only in operation through interpretation and temporarily exists in the form of the instructions with which the processor 16 is controlled at the moment when the processing instructions are executed directly by an interpreter. Hybrid systems, as known per se, can also be used.

The representation codes 23–25 according to the present example form part of a file 26 and each form a set of instructions in the form of a script. These scripts each form a job setting, i.e. a combination of instructions applying to the assembly of a series of mail pieces. By means of selection code 27, a window with options is presented to a user on a display in the form of a viewing screen 38 (FIG. 1) which is connected with the control unit 3. After a user (this is generally not the person who has composed the scripts) has entered a choice via a keyboard 35, the selected script, in this case script no. 3, is processed by the conversion operation 37 into active processing code 19 with which the processes "parameter preparation" 28 and "processing and transformations" 29 are controlled.

The processing phase "parameter preparation" 28 concerns processing the rough printing instructions 20 in accordance with the processing instructions 19 into a set of printing instructions 30 with prepared parameters. Parameters according to the script can be, for instance: "supplement inserts" with the contemplated number of sheets being "3". During the processing phase "parameter preparation" 28, from the printing instructions, the number of sheets is determined and for each set of items intended for a mail piece it is filled in by way of parameter values whether for that set a first insert and a second insert are to be supplied. A further example is that during the parameter preparation for each document the address data to be printed on an envelope are retrieved from a database and for each document are included as a parameter value in the intermediate file 30.

During the processing phase "processing and transformations", the intermediate file 30 is further processed into a file which indicates for each specimen of the mail pieces to be assembled from which of the insert feeding stations 7, 8 inserts are to be supplied, or not. During this phase, transformations can take place as well. Thus, the order of the mail items in the file 30 can be changed, for instance on the basis of address data obtained from the documents, to obtain a sorting which makes it possible to present the mail pieces in presorted condition to, for instance, the postal services. Another sorting possibility, for instance, is one whereby first, mail pieces that can be provided with a first franking are assembled, and then mail pieces that require a different franking are assembled. Further, it is possible to make use of external services 31, for instance to verify address data or to send data regarding mail pieces to be assembled for, for instance, overseas destinations, to an overseas processing unit.

The processing code is obtained according to the present example by processing a script code 22 being processed. In order to make this possible in a simple manner, there is provided a code generator 32 for generating the representation code 22. This code generator constitutes a setting dialog code 32 which presents a user interface with options from predetermined subsets of processing instructions and which offers the possibility of filling in parameter values. These subsets are stored as basic components in a file 33 and, in response to choices entered with the aid of the user interface of the setting dialog 32, are included in the script code being processed 22, The file 33 provides a set of processing subroutines with which representation codes for causing the processing instructions to be represented in humanly perceptible form can be composed which differ from each other at least as regards processing instructions included therein and which are each convertible to a processing code corresponding with that representation code for controlling the control unit 3 to process the rough print file 20 into a processed print file 21. As a result, the software for the processing code 19 can be limited to those processing subroutines that are needed for the respective application and parts that are not necessary can be left out. It may then be advantageous for standard subroutines that occur very frequently to be fixedly included in the processing code.

The file of basic components 33 is also consulted during conversion of a script by the conversion operation 37 in response to references, found in the script, to basic components in that file 33. The basic components can also include instructions in the form of parts of script, in which case in response to selection of those basic components those parts of script are included in the script code being processed 22. For executing the processing operations according to those parts of script, the converter does not need to consult the file 33 with basic components.

When the settings that can be set via the setting dialog 32 have been set, the script code being processed 22 can be shown and edited with the aid of script editing code 34. The script editing code 34 is preferably a word processor with provisions for the shortened input and check of script, but also a word editing program can be used as script editing code 34. Next, with the aid of the script, processing operations can be added which cannot be obtained by means of the setting dialog 32. In particular, processing instructions and in particular variables, including formal parameters, are represented and it is made possible to edit these in order to enter other variables, including other formal parameters, to change processing operations and to enter new processing operations.

When a script code being processed 22 is ready, it can be stored as part of the file 26 from which a script can be selected in accordance with which the processing of a print file is to be executed.

Although according to the present example the representation code contains the processing instructions in a script language, it can also be drafted in a different source language such as C, C++, Pascal or, for instance, a fourth-generation language for production planning However, the use of a script language provides the advantage that desired processing operations can be specified rapidly and flexibly.

The converter code for the conversion operation 37 can form part of the software belonging to the system or form part of standard software present. It is also possible to have the conversion carried out elsewhere, after which the processing code is returned in a form executable by the control unit and stored, for instance in association with the representation code, to document the content of the processing code. However, the presence of a converter on the system provides the advantage that instructions in the form of representation code can be carried out directly and stepwise, without first requiring a formal intermediate step of complete conversion.

The system proposed can not only be applied in complete systems, but can also be supplied in the form of computer software which is suitable for application for controlling existing systems.

In the following, an example is represented of a script in "Visual Basic Script", the purpose of which part is to supplement addresses and to send all addressees in Amsterdam an insert "Tulip".

The print file consists of letters which can be printed on a page. The letters are to be folded in the shape of a Z and to be inserted in a C5/6 window envelope. The text behind a' sign is an explanation. This script is an example of a representation code such as the scripts 22–25 in FIG. 2.

```
Sub ApplyJob(aPrintFile, aMAILFile)
  ' aPrintFile is the name of the print file 20
  ' aMAILFile is the name of the processed print file 21
  'Declaration of variables
  Dim MailSet
  Dim MAILFile
  Dim PrintFile
  Dim Page
  Dim PageNo
  Dim Company
  Dim Attn
  Dim Street
  Dim City
  Dim Country
  ' Retrieve the print file 20
  Set PrintFile = CreateObject("ApplyJob.PrintFile")
  PrintFile.LoadPages (aPrintFile)
  ' Create the processed print file 21
  Set MAILFile = CreateObject("ApplyJob.MAILFile")
  ' Start with the first page
  PageNo = 1
  ' Process all pages in the file
  While PageNo <= PrintFile.PageCount
    ' Add a new mail piece
    Set MailSet = MAILFile.MailSets.Add( )
    ' Add the page to the mail piece
    Set Page = MailSet.Pages.Add( )
    ' Read the printing instructions of the page
    Page.FilePath = PrintFile.PageFilePath(PageNo)
    ' Extract text from a particular position of the page being processed
    Company = GetWindowText(PrintFile, PageNo, 95, 258, 200, 263)
    Attn = GetWindowText(PrintFile, PageNo, 95, 253, 200, 258)
    Street = GetWindowText(PrintFile, PageNo, 95, 248, 200, 253)
    City = GetWindowText(PrintFile, PageNo, 95, 243, 200, 248)
    Country = GetWindowText(PrintFile, PageNo, 95, 238, 200, 243)
    ' Add address information to the mail piece
    MailSet.Attributes.Add("Company Name")
    MailSet.Attributes.Item("Company Name").Value = Company
    MailSet.Attributes.Add("Attn")
    MailSet.Attributes.Item("Attn")Value = Attn
    MailSet.AttributesAdd("Street")
    MailSet.Attributes.Item("Street").Value = Street
    MailSet.Attributes.Add("City")
```

-continued

```
    MailSet.Attributes.Item("City").value = City
    MailSet.Attributes.Add("Country")
    MailSet.Attributes.Item("Country").Value = Country
    ' Add an insert if address is in Amsterdam
    If (City = "Amsterdam") Then
      MailSet.Inserts.Add("Tulip")
    End If
    ' Specify envelope
    MailSet.Envelope = "C5/6 windowed"
    ' Specify fold
    MailSet.Fold = "Z-fold"
    ' Continue with next page
    PageNo = PageNo + 1
Wend
' All pages have been processed
' Store processed print file 21
MAILFile.Save (aMAILFile)
' Ready
    End Sub
```

The processed print file has now been adapted for controlling the printer 1 and the processing device 2. In a very simple manner, this script can be changed, for instance for adding an algorithm which determines the postcode with the aid of an external file and adds it and then an algorithm which on the basis of any desired selection from and/or ordering of the postcodes, carries out processing operations on the print file.

What is claimed is:

1. A system for generating printed mail pieces, starting from a print file, comprising:

a printer for printing postal items;

a processing device for processing printed postal items into mail pieces, the processing device comprising at least one mechanical device for mechanically acting upon said printed postal items;

a control unit for controlling the printer and the processing device, comprising an input interface for inputting a rough print file for controlling the printer, wherein the rough print file at least partly defines at least one document to be printed, a processor for processing the rough print file in accordance with processing instructions into a processed print file, the processed print file comprising instructions for controlling the printer and the processing device, an output interface connected with said printer and with said processing device for transmitting control signals to at least said printer or said processing device for controlling said printer and said processing device in accordance with, or formed by, said processed print file, and memory containing:

processing code for controlling said control unit for processing said rough print file into the processed print file, which processing code comprises processing instructions; and representation code for causing said processing instructions to be represented in humanly interpretable form, said representation code being editable by an operator of said system for changing at least said representations of said processing instructions, and said representation code being convertible into an accordingly changed version of said processing code.

2. A system according to claim 1, wherein said processing instructions include variables and wherein said representation code is arranged for editably representing at least variables of said processing instructions.

3. A system according to claim 1, wherein said processing instructions include formal parameters and wherein said representation code is arranged for editably representing at least formal parameters of said processing instructions.

4. A system according to claim 1, further comprising a display for representing said representation code in humanly interpretable form, said display being connected with said control unit.

5. A system according to claim 1, wherein said representation code is arranged for representing said processing instructions in a source language.

6. A system according to claim 5, wherein said source language is a script language.

7. A system according to claim 5, wherein said memory further contains converter code for converting said source language into a code executable by said control unit.

8. A system according to claim 5, wherein said editing code comprises a code generator for generating at least portions of said representation code, which code generator is arranged for causing a user interface to be represented, with choices from predetermined sets of processing instructions.

9. A system according to claim 1, wherein the at least one mechanical device includes at least one of an inserter device, an insert feeder device and a folding device.

10. A system according to claim 1, wherein the representation code is arranged to cause a subset of the processing instructions of the processing code to be editably represented.

11. A system for generating printed mail pieces, starting from a print file, comprising:

a printer for printing postal items;

a processing device for processing printed postal items into mail pieces, the processing device comprising at least one mechanical device for mechanically acting upon said printed postal items;

a control unit for controlling the printer and the processing device, comprising an input interface for inputting a rough print file for controlling a printer, wherein the rough print file at least partly defines at least one document to be printed, a processor for processing the rough print file in accordance with processing instructions into a processed print file, the processed print file comprising instructions for controlling the printer and the processing device, an output interface connected with said printer and with said processing device for transmitting control signals to at least said printer or said processing device for controlling said printer and said processing device in accordance with, or formed by, said processed print file, and memory containing:

a set of processing subroutines with which processing subroutines representation codes for causing said processing instructions to be represented in humanly interpretable form can be composed, which representation codes differ from each other at least as regards processing instructions included therein, are editable by an operator of said system for changing at least said representations of said processing instructions, and are each convertible into a processing code, corresponding with the respective representation code, for controlling said control unit for processing said rough print file into said processed print file, the processed print file comprising instructions for controlling the printer and the processing device.

12. A system according to claim 11, wherein said processing instructions include variables and wherein said representation code is arranged for causing at least variables of said processing instructions to be editably represented.

13. A system according to claim 11, wherein said processing instructions include formal parameters and wherein said representation code is arranged for causing at least formal parameters of said processing instructions to be editably represented.

14. A system according to claim 11, further comprising a display for representing said representation code in humanly interpretable form, said display being connected with said control unit.

15. A system according to claim 11, wherein said representation code is arranged for representing said processing instructions in a source language.

16. A system according to claim 15, wherein said source language is a script language.

17. A system according to claim 15, wherein said memory further contains converter code for converting said source language into a code executable by said control unit.

18. A system according to claim 15, wherein said editing code comprises a code generator for generating at least portions of said representation code, which code generator is arranged for causing a user interface to be represented, with choices from predetermined sets of processing instructions.

19. A system according to claim 11, wherein the at least one mechanical device includes at least one of an inserter device, an insert feeder device and a folding device.

20. A system according to claim 11, wherein the representation code is arranged to cause a subset of the processing instructions of the processing code to be editably represented.

21. A computer readable medium containing a computer program code for controlling a control unit for controlling a printer and a processing device for processing printed postal items into postal sets, the processing device comprising at least one mechanical device for mechanically acting upon said printed postal items, said computer program code comprising:

processing code for controlling said control unit for processing a rough print file for controlling a printer into a processed print file for controlling the printer and the processing device for processing printed postal items into mail pieces, which processing code comprising processing instructions, and representation code for causing said processing instructions to be represented in humanly interpretable form, the representation code being editable by an operator of a system comprising said printer and said processing device for changing at least the representations of said processing instructions, and said representation code being convertible into an accordingly changed version of said processing code.

22. A computer readable medium containing a computer program code for controlling a control unit for generating processing codes for controlling a control unit for processing a rough print file for controlling a printer into a processed print file for controlling the printer and a processing device for processing printed postal items into mail pieces, the processing device comprising at least one mechanical device for mechanically acting upon said printed postal items, said computer program code comprising:

a set of processing subroutines, with which processing subroutines representation codes for causing processing instructions to be represented in humanly interpretable form can be composed which representation codes differ from each other at least as regards processing instructions included therein, are editable by an operator of a system comprising said printer and said processing device for changing at least said representations of said processing instructions, and are each convertible into a processing code corresponding with the respective representation code, for controlling said control unit for processing said rough print file into said processed print file, the processed print file comprising instructions for controlling the printer and the processing device.

23. A system for generating printed mail pieces, comprising:

printing means for printing postal items;

processing means for processing printed postal items into mail pieces;

control means for controlling the printer and the processing device; and memory means for storing:

processing code for controlling said control unit for processing said rough print file into the processed print file, which processing code comprises processing instructions and representation code for causing said processing instructions to be represented in humanly interpretable form, said representation code being editable by an operator of said system for changing at least said representations of said processing instructions, and said representation code being convertible into an accordingly changed version of said processing code.

* * * * *